US011435123B2

(12) United States Patent
Fauser et al.

(10) Patent No.: US 11,435,123 B2
(45) Date of Patent: Sep. 6, 2022

(54) REFRIGERATION SYSTEM WITH TRANSFER SYSTEM

(71) Applicant: TOROMONT INDUSTRIES LTD., Concord (CA)

(72) Inventors: David Fauser, Toronto (CA); Josh Bell, Innisfil (CA); Wayne Borrowman, Scarborough (CA)

(73) Assignee: TOROMONT INDUSTRIES LTD, Concord (CA)

( * ) Notice: Subject to any disclaimer, the term of this patent is extended or adjusted under 35 U.S.C. 154(b) by 158 days.

(21) Appl. No.: 16/720,663

(22) Filed: Dec. 19, 2019

(65) Prior Publication Data

US 2020/0200456 A1 Jun. 25, 2020

Related U.S. Application Data

(60) Provisional application No. 62/860,555, filed on Jun. 12, 2019, provisional application No. 62/781,966, filed on Dec. 19, 2018.

(51) Int. Cl.
*F25B 45/00* (2006.01)

(52) U.S. Cl.
CPC ..... *F25B 45/00* (2013.01); *F25B 2345/002* (2013.01); *F25B 2345/003* (2013.01); *F25B 2500/221* (2013.01)

(58) Field of Classification Search
CPC ..... F25B 45/00; F25B 2500/221; F25B 2345/003; F25B 2345/002
See application file for complete search history.

(56) References Cited

U.S. PATENT DOCUMENTS

| | | | | |
|---|---|---|---|---|
| 5,046,320 | A | 9/1991 | Loose et al. | |
| 6,997,000 | B2 * | 2/2006 | Hirota | F25B 41/20 62/174 |
| 7,010,927 | B2 | 3/2006 | Lifson et al. | |
| 10,837,685 | B2 * | 11/2020 | Noor | F25B 41/22 |
| 2005/0097904 | A1 | 5/2005 | Lifson et al. | |
| 2012/0041608 | A1 * | 2/2012 | Zugibe | G06F 30/39 700/285 |
| 2015/0059367 | A1 | 3/2015 | Emo et al. | |
| 2015/0267951 | A1 * | 9/2015 | Berg | F25B 49/02 62/77 |
| 2020/0011575 | A1 * | 1/2020 | Zhao | F25B 41/30 |

FOREIGN PATENT DOCUMENTS

| | | | | |
|---|---|---|---|---|
| JP | 10253203 | A | 9/1998 | |
| WO | 2014130530 | A1 | 8/2014 | |
| WO | WO-2018169844 | A1 * | 9/2018 | F25B 41/30 |

* cited by examiner

*Primary Examiner* — Ana M Vazquez
(74) *Attorney, Agent, or Firm* — Norton Rose Fulbright Canada LLP

(57) ABSTRACT

A refrigeration system has a main refrigeration circuit including a compression stage, a condensing stage, and an evaporation stage, a refrigerant circulating between the compression stage, the condensing stage and the evaporation stage in a refrigeration cycle. An integrated transfer system is in closeable and openable fluid communication with the main refrigeration circuit, the transfer system including a receiver. Valves are operable to selectively open the fluid communication between the main refrigeration circuit and the transfer system. A motive force source displaces refrigerant from the main refrigeration circuit to the transfer system.

21 Claims, 3 Drawing Sheets

REFRIGERATION SYSTEM WITH TRANSFER SYSTEM

CROSS-REFERENCE TO RELATED APPLICATIONS

This application claims priority from U.S. Provisional Patent Application No. 62/781,966 filed on Dec. 19, 2018 and U.S. Provisional Patent Application No. 62/860,555 filed on Jun. 12, 2019, the entire contents of which are incorporated by reference herein.

FIELD OF THE APPLICATION

The present application relates to refrigeration systems used in industrial refrigeration applications and more particularly to a transfer system used as temporary refrigerant storage.

BACKGROUND OF THE ART

Industrial-size refrigeration systems are used in numerous applications. For example, supermarkets, large-scale buildings, sporting facilities, industrial cooling facilities are among the numerous instances in which central refrigeration systems are used. The central refrigeration systems may be used for refrigerating foodstuff, for air-conditioning space, for operating freezers, for maintaining ice-playing surfaces (also known as ice sheets).

In such centralized refrigeration systems, many of the components are kept in a mechanical room or like enclosed room, in which the refrigerant cycles via a series of compressors. Therefore, a mechanical room typically has a network of incoming and outgoing pipes, automated and manual valves, receivers, heat exchangers and/or sensors, though some of these components may be in other locations.

There results a risk of refrigerant leaks in the mechanical room, as elsewhere in a refrigeration system, due to the number of components and connections between components. A refrigerant leak is a potential environmental concern and if the leak occurs in a closed environment such as a mechanical room it may also be a safety hazard. Depending on the nature of the refrigerant, a refrigerant may be toxic, or a refrigerant leak can render the environment of the equipment unbreathable.

One known approach to remove refrigerant from a system safely is through the use of a portable refrigeration pump-out system. To deploy this type of system takes coordination, delivery of equipment and personal protective equipment to enter a contaminated space. Once a pump-out system is delivered to a contaminated site, it needs to be physically connected to the refrigeration plant and the facilities electrical system. Moreover, in spite of the personal protective equipment, staff needs to enter the contaminated space, increasing the potential to refrigerant exposure.

SUMMARY OF THE APPLICATION

It is therefore an aim of the present disclosure to provide a refrigeration system with a transfer system that addresses issues associated with the prior art.

Therefore, in accordance with an embodiment of the present disclosure, there is provided a refrigeration system comprising a main refrigeration circuit including at least a compression stage, a condensing stage, and an evaporation stage, a refrigerant circulating between the compression stage, the condensing stage and the evaporation stage in a refrigeration cycle; and an integrated transfer system in closeable and openable fluid communication with the main refrigeration circuit, the transfer system including at least one receiver; valves operable to selectively open the fluid communication between the main refrigeration circuit and the transfer system; and a motive force source to displace refrigerant from the main refrigeration circuit to the transfer system.

In accordance with another embodiment of the present disclosure, there is provided a system for transferring a refrigerant from a main refrigeration circuit to a transfer system, comprising a processing unit; and a non-transitory computer-readable memory communicatively coupled to the processing unit and comprising computer-readable program instructions executable by the processing unit for: opening a fluid communication between the main refrigeration circuit and the transfer system integrated to the system, and activating a motive force source to draw refrigerant from the main refrigeration circuit to a receiver in the transfer system.

In accordance with yet another embodiment of the present disclosure, there is provided a system for transferring a refrigerant from a main refrigeration circuit to a transfer system, comprising: a processing unit; and a non-transitory computer-readable memory communicatively coupled to the processing unit and comprising computer-readable program instructions executable by the processing unit for: opening a fluid communication between a low pressure side of the main refrigeration circuit and the transfer system, and activate a motive force source to draw liquid refrigerant from the low pressure side of the main refrigeration circuit to a receiver in the transfer system.

DESCRIPTION OF THE PREFERRED EMBODIMENTS

Figure 1:
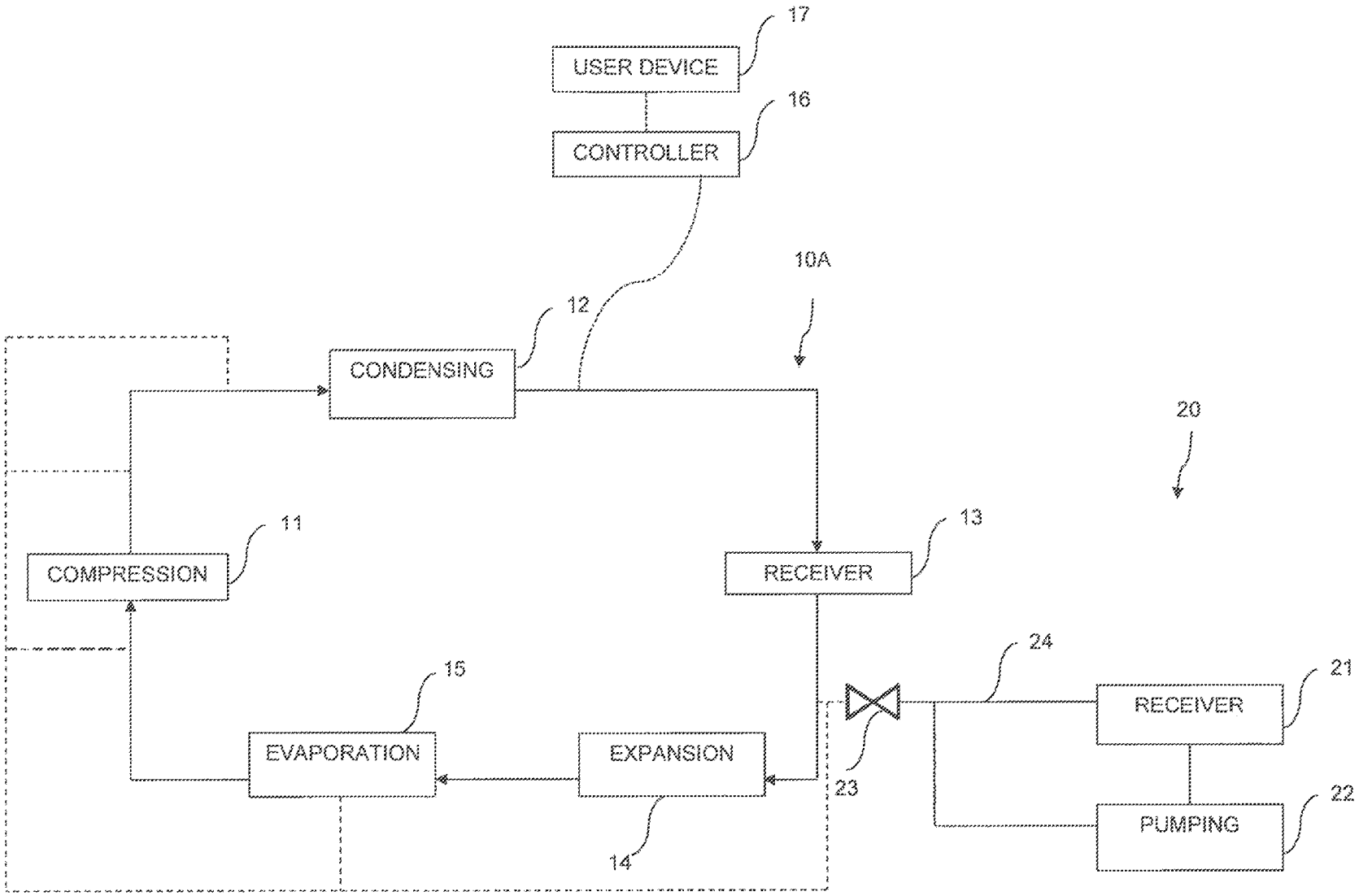
FIG. 1 is a block diagram of a refrigeration system with a transfer system in accordance with the present disclosure.

Referring to FIG. 1, a refrigeration system with integrated transfer system is illustrated at 10, and is provided as an example. The refrigeration system 10 may have a conventional refrigeration circuit (referred to as main refrigeration circuit and shown as 10A for reference purposes) featuring a compression stage 11, a condensing stage 12, a receiver 13, an expansion stage 14 and/or an evaporation stage 15. Refrigerant enters compressor(s) in the compression stage 11 as a saturated vapor and is compressed to a higher pressure and temperature. The compressed refrigerant vapor is then routed to the condensing stage 12 where it is cooled and condensed into a liquid by flowing through a condenser unit(s), in which the refrigerant circulates through coils with a coolant such as cooling water or cooling air flowing across the coils, whereby the circulating refrigerant rejects heat from the refrigeration system, the rejected heat is carried away by either the liquid (e.g., water, glycol) or the air (or like gas coolant) depending on the type of condenser unit used, as described below. In essence, a condenser unit is where a vapor refrigerant is condensed into a liquid refrigerant. The condensing stage 12 may also include heat reclaim. Different types of condenser units may be used as part of the condensing stage 12, with one or more condenser unit in the refrigeration system 10, such as air-cooled condenser units, gas coolers, evaporative condenser units, and water-cooled condenser units.

The condensing liquid refrigerant may then be accumulated in one or more receivers 13. The receiver(s) is one or more storage vessels (i.e., tank, reservoir) in which the refrigerant is stored mostly in a liquid state, with vapour.

The condensed liquid refrigerant may next be directed through an expansion stage 14 in which valve(s) of any type, such as expansion valves, causes a reduction in pressure to the refrigerant. Other mechanisms may also be used, including flooded configurations with a pump or pumps. The pressure reduction results in a lowering of the temperature of the refrigerant to reach a temperature colder than the temperature of the space or surface to be refrigerated. The cold refrigerant is then circulated in the coil or tubes of evaporator(s) of the evaporator stage 15, by which the cold refrigerant absorbs heat from a fluid, such as a liquid or a gas depending on the application with which the refrigeration system 10 is used. The evaporation stage 15 is where the refrigerant absorbs and removes heat which is subsequently rejected in the condensing stage 12. The coils of the evaporator stage 15 may be part of refrigerated enclosures, such as in supermarket, in a slab of an ice sheet, etc. As another possibility, the coils of the evaporator stage 15 are part of a heat exchanger, with the refrigerant of the refrigeration system 10 being in heat exchange with a coolant (e.g., glycol, brine). In an embodiment, the coolant circulates in coils of an ice sheet. Other arrangements are considered as well, depending on the contemplated use of the refrigeration system 10.

To complete the refrigeration cycle, the vapor resulting from the evaporation stage 15 is again a saturated vapor and is cycled into the compression stage 11. The circuit portion of the refrigeration system 10 between the compression stage 11 and the expansion stage 14 (including the condensing stage 12 and receiver(s) 13) may be referred to as the high-pressure side as the refrigerant pressure is higher in comparison to a circuit portion of the refrigeration system 10 between the expansion stage 14 and the compression stage 11 (including the evaporation stage 15), itself referred to as the low-pressure side. The demarcation between high-pressure side and low-pressure side may be elsewhere, such as at pressure regulating valve for transcritical refrigeration.

The refrigeration system 10 is schematically shown in FIG. 1 as a simplified example of a system capable of operating a refrigeration cycle. However, multiple other features and components may be added to the refrigeration system 10, such as defrosting, heat reclaiming, receivers, oil systems, to name but a few, as well as the appropriate piping and valves to ensure that the refrigerant is directly to the various components as desired. The refrigeration system 10 may also include a plurality of compressors (e.g., in parallel, cascaded, dedicated), condensers, evaporators, depending on the refrigeration load of the system 10. Moreover, different types of refrigerant may be used, including synthetic fluorocarbon refrigerants and their blends (e.g., HCFC, HFC, HFO and blends thereof), ammonia, $CO_2$ refrigerant, hydrocarbon refrigerant, etc, for different uses, such as industrial refrigeration (e.g., process refrigeration, industrial cold storage), ice-playing surfaces (a.k.a., ice sheets), supermarket refrigeration, HVAC, among possibilities.

A controller unit 16 may be used to centrally control the various components and stages of the refrigeration system 10. The controller unit 16 is the processing unit of the refrigeration system 10, and may have one or more processors. A non-transitory computer-readable memory may be communicatively coupled to the processing unit and may have computer-readable program instructions executable by the processing unit for operating a transfer cycle described herein.

The controller unit 16 has a processor with user interfaces, and may receive data from various sensors located at different locations in the refrigeration system 10 and in the environment of the refrigeration system 10, e.g., temperature and pressure sensors, etc. The controller unit 16 may also communicate with the components of the refrigeration system 10, to turn them on and off, and to adjust their operating parameters. This may include the operation of valves (e.g., solenoid valves) located throughout the refrigeration system 10. The controller unit 16 may also be in communication with user applications that can seek operator guidance remotely. This is shown by way of a user device 17 in wireless communication with the controller unit 16, for instance by cellular network and/or internet, etc.

Although not shown, the controller unit 16 receives operational data from various sensors in the refrigeration system 10. This may include numerous readings from pressure sensors to identify a problematic condition. For example, the controller unit 16 may monitor pressure data from the various pressure sensors, so as to identify a system pressure lower than a low-pressure limit, which may indicate a leak. Another type of sensor would be a refrigerant detector external to the refrigerant circuit to detect the presence of refrigerant in ambient air, with such refrigerant detector providing its readings to the controller unit 16. The controller unit 16 may therefore obtain readings from various sensors, strategically positioned at leak-prone locations, e.g., at the outlet of pressure relief valves, or in the environment of the compression stage 11 or of the condensing stage 12. The controller unit 16 may also detect a refrigerant leak into a secondary coolant such as water, brine, or glycol, in the manners described above. One way the controller unit 16 may detect a leak may be to monitor a change in the secondary coolant such as pH or through presence of refrigerant gas, with appropriate sensors. As another possibility, a level sensor(s) may also be used to indicate a refrigerant leak. More particularly, in an embodiment, one or more level sensors may be provided in various locations in the refrigeration system 10 such as the receiver 13 where a drop in refrigerant level could indicate a loss of refrigerant. When the pressure is beyond a predetermined threshold, or when refrigerant beyond a given level is present in the ambient air, or when a leak is detected in any appropriate way, the controller unit 16 may alarm the operator, and may also automatically perform a refrigerant transfer as described below.

Still referring to FIG. 1, the refrigeration system 10 includes a transfer system 20 in fluid communication with the main refrigeration circuit 10A described above, in selected circumstances. The expression "transfer circuit" may also be used. The transfer circuit/system 20 may be operated on its own, for instance during shutdown of the refrigeration circuit 10A. The transfer system 20 may be said to be integrated to the refrigeration system 10, as it is not a portable system but is instead an embedded part of the refrigeration facilities, i.e., it is a Siamese system with the refrigeration circuit 10A, it is a permanent part of the refrigeration facility as tied to the refrigeration system 10. The transfer system 20 may also be said to be part of the refrigeration system 10. The transfer system 20 may be operated to reduce the amount of refrigerant in the main refrigeration circuit 10A. This may occur in given circumstances, such as for maintenance purposes, or as an emergency procedure in conditions of refrigerant leakage in the main refrigeration circuit 10A. In an embodiment, the transfer system 20 may be connected directly to a portion of a large refrigeration system (such as the main refrigeration circuit 10A), somewhere out in the building or to the main part in the machinery room, so as to transfer refrigerant on occurrence of a leak.

The transfer system 20 is shown generically in FIG. 1 as having one or more receivers 21 that defines the main receiving volume in which refrigerant will be accumulated. The receiver(s) 21 may also be referred to as vessel, tank, reservoir. The receiver(s) 21 may be in the mechanical room or in proximity to the receiver 14 of the main refrigeration circuit 10A, or may be remotely located as well. Moreover, even though the receiver 21 is shown as being a standalone receiver, it is contemplated to use the receiver 13 of the main refrigeration circuit 10A, with an appropriate network of pipes and/or valves to isolate the receiver 13 from feeding liquid refrigerant to the main refrigeration circuit 10A when a transfer cycle is initiated, as explained below. Hence, in some embodiments described herein, even though the expression "receiver 21" is used, it may include the receiver 13. In an embodiment, the receiver 21 is located on a roof or in a space that is secured reducing the risk of refrigerant exposure in the mechanical room. The transfer system 20 may also have some motive force source 22 for the refrigerant to be drawn into the transfer system 20, although the motive force could be provided by the compression stage 11 of the main refrigeration circuit 10A as well, or other pumps of the system. However, as the transfer operation may occur in leakage conditions, it may be desired that the motive force be provided by components dedicated to the transfer system 20. This is generally shown in FIG. 1 as pumping stage 22, with the pumping stage 22 implemented for example by one or more compressors and/or by one or more pumps.

The receiver(s) 21 and pumping stage 22 are in selective fluid communication with the main refrigeration circuit 10A by way of valves 23 (e.g., 23A-23D in FIG. 2) and line(s) 24 (shown in various segments 24A-24D in FIG. 2), so as to define one or more refrigerant paths for refrigerant to reach the receiver 21. The lines 24 are pipes, tubes, tubing, for instance in a network, the lines 24 being branched to the network of pipes of the main refrigeration circuit 10A, and/or to components of the main refrigeration circuit 10A, such as the receiver(s) 13 (if the latter is not used as receiver 21). The valves 23 are one or more valves manually or automatically operable to open the fluid communication between the main refrigeration circuit 10A and the transfer system 20. For example, the valves 23 may include solenoid valves or like remotely operable valves for the controller unit 16 to operate a transfer cycle by which the main refrigeration circuit 10A may be purged from a substantial part of the refrigerant, with the transfer system 20 accumulating the refrigerant. A return cycle may also be operated by which the refrigerant is returned back to the main refrigeration circuit 10A, for instance by using the motive force source of the transfer system 20 and/or other motive force source such as that of the main refrigeration circuit 10A, including one or more of the compressors from the compression stage 10.

The transfer system 20 is permanently installed as part of the refrigeration system 10. It is integrated to the refrigeration system 10, and not a plug-on portable system. The pipes 24 may for example be permanently connected to a pipe network of the refrigeration system 10. Once the refrigerant is transferred to the transfer system 20, the main refrigeration circuit 10A may be examined, a leak can be located, a damaged component may be repaired. While doing so, there is limited refrigerant exposure due to the transfer of the refrigerant to the transfer system 20, for instance remotely located.

Figure 2:
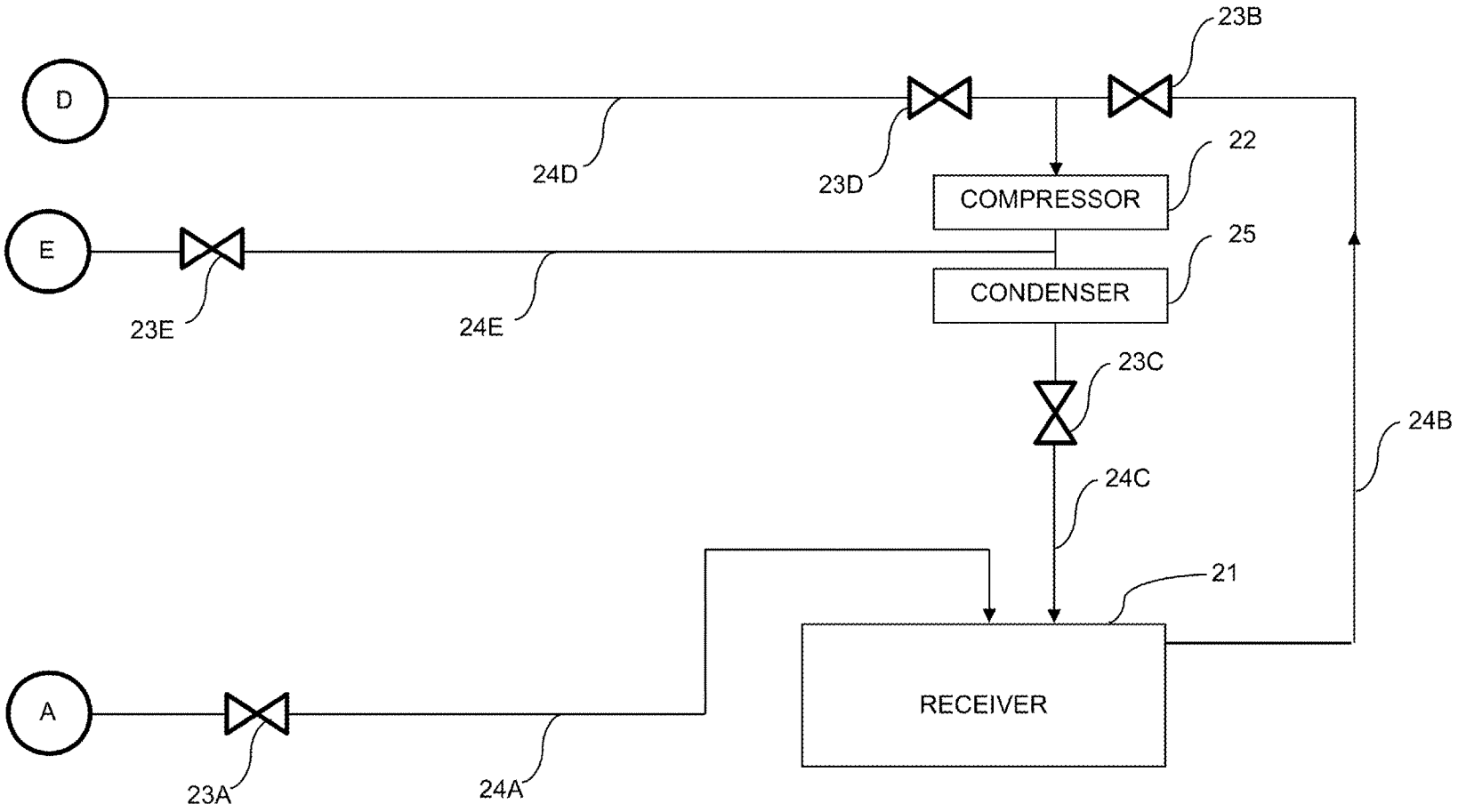
FIG. 2 is a schematic view of the transfer system of the refrigeration system of FIG. 1, in accordance with an embodiment of the present disclosure.

Referring to FIG. 2, an embodiment of the transfer system 20 is shown. The transfer system 20 uses a dedicated compressor 22 as the motive force source or as part of the motive force source. The compressor 22 is said to be dedicated in that its primary purpose is to operate the transfer system 20 and/or it may be the one compressor among all compressors of the compression stage 11 that is tasked with operating the transfer, and cause refrigerant to be accumulated into the receiver 21 from the main refrigeration cycle 10A. The transfer system 20 may be connected to the main refrigeration circuit 10A at different locations. The lines 24 (FIG. 1) may include a line 24A that is connected to a liquid line of the main refrigeration circuit 10A or to the receiver 13. The line 24A is therefore used to direct refrigerant in a liquid state into the transfer system 20, and more particularly to the receiver 21. One of the valves 23, shown as valve 23A, is in the line 24A and is operable to open the fluid communication between the main refrigeration circuit 10A and the transfer system 20. The line 24A is not connected directly to the compressor 22 so as not to feed the compressor with liquid refrigerant. The compressor 22 is connected to the receiver 21 by way of line 24B. Line 24B may be connected to a top portion of the receiver 21 to feed the compressor 22 with refrigerant in a vapor state (a.k.a., gaseous or gas state). To ensure proper operation, valve 23B may be in the line 24B, the valve 23B being opened when the compressor 22 exerts a suction on the main refrigeration circuit 10A to draw in the liquid refrigerant via line 24A. Other valves may be present where appropriate (e.g., check valves, manual valves, etc) but are not show for the simplicity of the figure.

Although not shown, it is contemplated to also use a pump as part of the motive force source 22, the pump for instance located in the line 24A. According to an embodiment, the sole motive force 22 is such a pump. In yet another embodiment, the compressor 22 is part of the compression stage 11 of the main refrigeration circuit 10A, with line 24B extending from the suction of the compressor 22 to the receiver 21. A similar valve arrangement (including valve 23C) may be present to close the discharge line from such a compressor 22 in the compression stage 11 to the condensation stage 12, for the refrigerant to be directed instead to the receiver 21, via line 24C.

The compressed refrigerant is condensed from a vapour to a liquid in the condenser 25, and transferred in line 24C to the received 21, with valve 23C controlling the flow. As exemplified in FIG. 3, the condenser 25 may be an autonomous condenser 25, such as one having a heat exchanger (e.g., plate exchanger) in which a coolant (e.g., glycol, brine) circulates from the heat exchanger to an air condenser 25A, for example, via circuit 25B. Consequently, the condenser 25 may be a condenser circuit with its own coolant (e.g., air, glycol, water, brine), or may be a mechanical device cooling the refrigerant circulating through the condenser 25. A loop consisting of the receiver 21, the line 24B, the compressor 22 and the line 24C ensures that a sufficient suction effect is present in the receiver 21, to draw the liquid refrigerant from the main refrigeration circuit 10A into the transfer system 20. The line 24A may be connected to the receiver 21 for the suction effect to draw in the liquid refrigerant.

Figure 3:
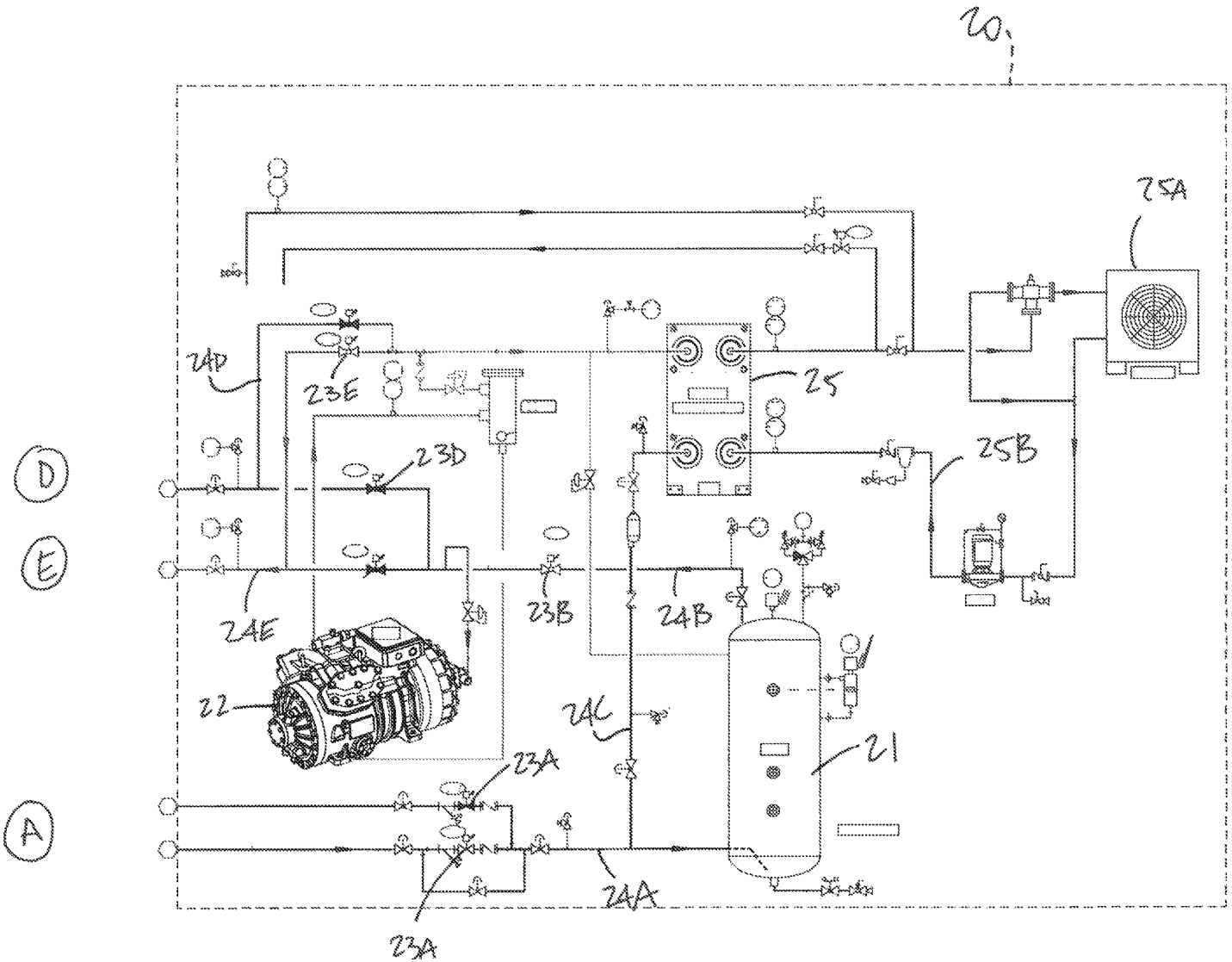
FIG. 3 is a schematic diagram of the transfer system of the refrigeration system of FIG. 1, in accordance with an embodiment of the present disclosure.

Still referring to FIGS. 2 and 3, the transfer system 20 may also be connected to a top end of the receiver 13, or at any other location to draw gaseous refrigerant from the main refrigeration circuit 10A, by way of line 24D. For example, the line 24D may be connected to a line extending from the condensation stage 12 to the receiver 13. In an embodiment, line 24D may be connected to a top portion of the receiver 13 of the main refrigeration circuit 10A to feed the compressor 22 with refrigerant in a vapor state (i.e., the gaseous refrigerant). Valve 23D may be in line 24D to open this path of fluid communication. Line 24E, with for instance valve 23E, may extend from the discharge of the compressor 22 to the main refrigeration circuit 10A, to be used as a pushing force. Valve 23E, like valves 23A, 23B, 23C and 23D, may be remotely operated valves, for example normally closed, such as solenoid valves, for the controller unit 16, with or without the assistance of a user via the user device 17, to operate the valves 23 through a transfer cycle. Other valves may be present, including manual valves to isolate parts of the transfer system 20, pressure-relief valves, check valves, etc. Moreover, sensors may be provided in the transfer system 20 for the controller unit 16 to monitor the transfer and actuate the various valves and components of the refrigeration circuit 10A and of the transfer system 20 involved in a transfer in and/or a transfer out of the transfer system 20.

Now that the various components of the transfer system 20 have been described, a method of operation is set forth.

At any given moment, a need for a transfer of refrigerant from the main refrigeration circuit 10A to the transfer system 20 will trigger a transfer cycle. The need may be imposed by the controller unit 16 detecting a leak, through the various sensors described above. The controller unit 16 may automatically initiate the transfer cycle, or may request confirmation or instructions of an operator via the user device 17 (e.g., smart phone), after alerting the operator. An automatic action from the controller unit 16 may occur in predetermined circumstances. For example, if a leak is detected at set high levels for a set period of time without operator command, the refrigeration system 10 may automatically transfer refrigerant to the transfer system 20. In another embodiment, the controller unit 16 receives a command for a transfer cycle from the user device 17. This may be for different reasons, including emergencies, maintenance, repairs, change of refrigerant, etc.

From a state in which valves 23A-23E are closed, some of the valves 23A-23E may be opened and the compressor 22 may be turned on. As a result, the transfer system 20 is in fluid communication with the main refrigeration circuit 10A, with the refrigerant path being via different lines. For example, one path, shown as including inlet A, includes line 24A and receiver 21, with a loop of line 24B, compressor 22, line 24C acting on the receiver 21 to create suction. Another path, shown as including inlet D, includes line 24D to compressor 22 and to receiver 21 via the condenser 25, via the opening of valve 23D. This path along with the path featuring line 24A are for the transfer out of the refrigerant, namely from the main refrigeration circuit 10A to the transfer system 20, for accumulation in the receiver 21. Another path is one by which refrigerant is pushed out of the transfer system 20 to the main refrigeration circuit 10A to be used as a push force to assist in directing liquid refrigerant into the receiver 21. This push path includes line 24E being put in fluid communication with the main refrigeration circuit 10A through the opening of valve 23E, to outlet E. As mentioned above, the receiver 21 may be the receiver 13. In such a scenario, an appropriate network of valves and pipes is arranged to replicate the set up shown in FIGS. 2 and 3. For simplicity, in the figures the receiver of the transfer system 20 is shown as 21 though it may include in some instances the receiver 13.

During a transfer cycle, the compressors from the compression stage 11 are turned off—although they may already be shut down—except if compressor 22 is part of the compression stage 11, though with proper isolation of such a compressor from the main refrigeration circuit 10A as described above. If a pump is part of the motive force source 22 (FIG. 1), the pump may also be turned on. According to an embodiment, the transfer system 20 proceeds to transfer liquid first from the main refrigeration circuit 10A. In an embodiment, the greatest amount of liquid is found in the low pressure side, namely downstream of the expansion stage 14, such as at the evaporation stage 15 (e.g. chiller, heat exchanger). Therefore, a step, that may be performed as first step, may include transferring the liquid refrigerant from the low pressure side. In such an embodiment, to remove the liquid refrigerant from the low pressure side, the refrigerant is drawn in via inlet A. Accordingly, valves 23A and 23B are open. Valve 23C may be open while valve 23D is closed. The compressor 22 is powered, whereby a suction effect is performed in the receiver 21, with line 24B on top of the receiver 21. In an embodiment, outlet E is used to push gaseous refrigerant into the low pressure side to assist in moving the liquid refrigerant from the low pressure side into the receiver 21. Therefore, valve 23E is opened, and as the compressor discharge is connected to the evaporation stage 15 via line 24E, a push force is effected on the liquid that is in the evaporation stage 15. The low pressure side is essentially isolated by the expansion stage 14 preventing a backward flow in the main refrigeration circuit 10A. Inlet A in FIGS. 2 and 3 therefore receives the liquid refrigerant from the evaporation stage 15 due to the suction effect on the receiver 21 and, in an embodiment, a push from the discharge of the compressor 22.

As another contemplated step, the liquid refrigerant that is on the high pressure side is transferred to the receiver 21. To do so, inlet A and outlet E may be used. The compressor discharge 24E is directed to the condensing stage 12 and/or to the receiver 13, if present, and if the receiver 13 is not used as transfer receiver 21 (as the receiver 13 could be used as transfer receiver 21 in an embodiment). Line 24A, with valve 23A open, is connected downstream of the condensing stage 12 and/or downstream of the receiver 13, if present, so as to collect the liquid refrigerant that is pushed by the discharge of the compressor 22.

The transfer process may thus include one or both of the liquid transfer steps. The transfer may be initiated at the low pressure side, as it may be the part of the main refrigeration circuit 10A accommodating the greatest amount of liquid refrigerant. However, it is also contemplated to begin the transfer process via the high pressure side. In both of these instances, some of the gaseous refrigerant from the compressor discharge at 22 may enter the condenser 25, be condensed to a liquid and transferred in line 24C to the receiver 21, with a valve 23C to control the flow.

As a result of one or both of these two steps, liquid refrigerant is conveyed to the receiver 21 from the main refrigeration circuit 10A. The controller unit 16 may monitor the pressure in the liquid portion of the main refrigeration circuit 10A, and end this step when the liquid refrigerant pressure is below a given threshold (e.g., 0 psi), and/or when the liquid level in the receiver 21 reaches a given threshold, etc.

Optionally, or alternatively, the refrigeration system 10 may operate another phase of a transfer cycle, with the compressors from the compression stage 11 remaining in an "off" condition, except if compressor 22 is part of the compression stage 11 as explained above. In this other phase, the gaseous refrigerant from the main refrigeration circuit 10A is transferred to the transfer system 20, while valve 23D opened with the compressor 22 still in operation. As a result, the transfer system 20 remains in fluid communication with the main refrigeration circuit 10A, with the refrigerant path being sequentially via line 24D, compressor 22, condenser 25/line 24C and receiver 21. Gaseous refrigerant may consequently be drawn into the transfer system 20, and condensed to reach the receiver 21 in a liquid condition.

In a similar fashion as in the transfer of liquid refrigerant, it is possible to transfer the gaseous refrigerant from the low pressure side and/or from the high pressure side of the main refrigeration circuit 10A, in any sequence. The gaseous refrigerant transfer to the transfer system 20 may even occur before the transfer of the liquid refrigerant. As one possible step, inlet D is connected to the suction line of the main refrigeration circuit 10A. Valves 23A, 23B and 23E are closed while valve 23C (if present) and 23D are open. The refrigerant from the suction line of the compression stage 11 is therefore drawn by inlet D and directed to the receiver 21, by the action of the compressor 22. The refrigerant may be condensed in the process, such as by the condenser 25. Another possible step is the transfer of the gaseous refrigerant from the high pressure side, such as from the discharge line of the compression stage 11. The compression stage 11 typically features valves for the compressors that prevent backflow to the compressors. According to this step, valves 23A, 23B and 23E remain closed while valves 23C and 23D are open. The compressor 22 is operational so as to create a suction effect on the discharge line of the compression stage 11 and hence transfer the discharge gaseous refrigerant from the high pressure side into the receiver 21, via the condenser 25.

The controller unit 16 may monitor the pressure in the high pressure side of the main refrigeration circuit 10A, and end this step when the refrigerant pressure in the high pressure side is below a given threshold (e.g., 0 psi). At null relative pressure, leakage may be minimal if present. The transfer cycle may thus be ended, with the compressor 22 turned off. It is considered to close valves 23A, 23D and/or 23E to isolate the transfer system 20 from the main refrigeration circuit 10A once the transfer cycle is complete.

To return the refrigerant in the main refrigeration circuit 10A, valve 23A may be opened, with the compressors of the compression stage 11 being operated. The suction effect of the compressors 11 will draw the refrigerant back into the main refrigeration circuit 10A. During the return cycle, the valves 23D and 23E may remain closed, though it is contemplated to use the compressor 22 to transfer refrigerant back into the main refrigeration circuit 10A, with the line network described above. For the return cycle, it is contemplated to have a line segment (not shown) connected to a bottom of the receiver 21. Moreover, another pump may be present in this line segment to assist in the return of the refrigerant in the main refrigeration circuit 10A. Other arrangements and/or systems are considered to return the refrigerant to the main refrigeration circuit 10A.

The transfer system 20 and the method of operating same may differ from the embodiment of FIG. 2. For example, the controller unit 16 may be dedicated to the transfer of gaseous refrigerant via line 24D, with block valves provided on the liquid circuit portion of the main refrigeration circuit 10A to isolate segments of the liquid circuit portion and conceal the liquid refrigerant therein.

The refrigeration system 10 may therefore be operated to effect a transfer of a refrigerant from a main refrigeration circuit to a transfer system. A processing unit in the form of controller unit 16, has a non-transitory computer-readable memory communicatively coupled to the processing unit and comprising computer-readable program instructions executable by the processing unit for: opening a fluid communication between the main refrigeration circuit 10A and the transfer system 20, and activate a motive force source 22 to draw refrigerant from the main refrigeration circuit 10A to one or more receiver(s) 21 in the transfer system 20.

The refrigeration system 10, with the transfer system 20 may be, in an embodiment, a permanently installed system that has its own receiver, i.e., not one of the receivers of the main refrigeration circuit 10A. Likewise, in an embodiment, the transfer system 20 may have its own separate compressor. The operation of a transfer system may be triggered by human interaction, but it may also be automatic. In the case of automatic activation, the automation connects with refrigerant leak sensors that engage the pump out of the refrigerant, into the transfer system 20, based on the refrigerant levels within a space, which space is not necessarily the engine room/mechanical room.

The invention claimed is:

1. A refrigeration system comprising:

a main refrigeration circuit including at least a compression stage and a condensing stage in a high-pressure side of the main refrigeration circuit, and an evaporation stage in a low-pressure side of the main refrigeration circuit, a refrigerant circulating between the compression stage, the condensing stage and the evaporation stage in a refrigeration cycle; and an integrated transfer system in closeable and openable fluid communication at least with the low-pressure side of the main refrigeration circuit, the transfer system including at least one receiver, valves operable to selectively open the fluid communication between the main refrigeration circuit and the transfer system, and a motive force source to transfer refrigerant in a liquid state from the low-pressure side of the main refrigeration circuit to the transfer system, wherein the motive force source is operable during a shutdown of the refrigeration cycle.

2. The refrigeration system of claim 1, wherein the motive force source includes a compressor of the compression stage of the main refrigeration circuit.

3. The refrigeration system of claim 1, wherein the motive force source includes a compressor dedicated to the integrated transfer system and separate from the compression stage of the main refrigeration circuit.

4. The refrigeration system of claim 3, wherein the motive force source includes a pump.

5. The refrigeration system of claim 3, wherein a suction line of the compressor dedicated to the integrated transfer system is connected to an upper portion of the receiver of the integrated transfer system, and a line extends from the main refrigeration circuit to a lower portion of the receiver to draw liquid refrigerant into the receiver.

6. The refrigeration system of claim 5, wherein a discharge of the compressor dedicated to the integrated transfer system is connected to the main refrigeration circuit to push refrigerant into the integrated transfer system.

7. The refrigeration system of claim 5, wherein a discharge of the compressor dedicated to the integrated transfer system is connected to a heat exchanger of the integrated transfer system for refrigerant to be condensed before being directed to the receiver.

8. The refrigeration system of claim 1, wherein the integrated transfer system is in closeable and openable fluid communication with the low-pressure side and the high-pressure side of the main refrigeration circuit.

9. The refrigeration system of claim 1, further comprising a controller unit for operating the integrated transfer system to transfer refrigerant into the integrated transfer system.

10. The refrigeration system according to claim 9, wherein the controller unit operates the integrated transfer system to transfer refrigerant from the integrated transfer system and back into the main refrigeration circuit.

11. The refrigeration system according to claim 1, including at least one sensor for detecting a condition relating to a refrigerant leak, and a controller unit for operating the integrated transfer system to transfer the refrigerant into the integrated transfer system upon the detection of the condition relating to the refrigerant leak.

12. A system for transferring a refrigerant from a main refrigeration circuit to a transfer system, comprising:

a processing unit; and a non-transitory computer-readable memory communicatively coupled to the processing unit and comprising computer-readable program instructions executable by the processing unit for:

opening a fluid communication between the main refrigeration circuit and the transfer system integrated to the system, shutting down the refrigeration cycle in the main refrigeration circuit, and activating a motive force source to transfer refrigerant in a liquid state from the main refrigeration circuit to a receiver in the transfer system.

13. The system according to claim 12, wherein opening the fluid communication between the main refrigeration circuit and the transfer system includes opening a fluid communication between a low-pressure side and/or a high-pressure of the main refrigeration circuit and the transfer system, to draw liquid refrigerant from the low pressure side of the main refrigeration circuit to the receiver in the transfer system.

14. The system according to claim 13, wherein opening a fluid communication between a low-pressure side and/or a high-pressure of the main refrigeration circuit and the transfer system includes opening the fluid communication with the low-pressure side first.

15. The system according to claim 13, wherein opening the fluid communication between the low-pressure side and/or the high-pressure of the main refrigeration circuit and the transfer system includes opening the fluid communication between the low-pressure side and/or the high-pressure after the refrigerant in the liquid state has been drawn to draw gaseous refrigerant into the transfer system.

16. The system according to claim 12, wherein activating the motive force source includes activing a compressor.

17. The system according to claim 16, wherein activating the compressor includes activing a compressor separate from the main refrigeration circuit.

18. The system according to claim 16, wherein activating a motive force source includes activating a pump.

19. The system according to claim 12, wherein transferring the refrigerant from the main refrigeration circuit occurs automatically after detecting a condition relating to a refrigerant leak.

20. The system according to claim 12, wherein the computer-readable program instructions executable by the processing unit are further for operating a heat exchanger for the refrigerant to be condensed before being directed to the receiver.

21. The system according to claim 12, wherein the computer-readable program instructions executable by the processing unit are further for activating another motive force source to return refrigerant from the transfer system to the main refrigeration circuit.

* * * * *